United States Patent [19]

Maurin et al.

[11] Patent Number: 5,014,454

[45] Date of Patent: May 14, 1991

[54] SMOOTHING IRON HAVING SCREEN PRINTED ENAMEL STRIPS WIDER AT THE FRONT AND NARROWER AT THE REAR OF THE PRESSING SOLE SURFACE

[75] Inventors: Bruno Maurin, St Symphoriendozon; Henri Piera, Annecy, both of France

[73] Assignee: SEB S.A., Selongey, France

[21] Appl. No.: 461,645

[22] Filed: Jan. 5, 1990

[30] Foreign Application Priority Data

Jan. 11, 1989 [FR] France ..... 89 00251

[51] Int. Cl.[5] ..... D06F 75/30; D06F 75/38

[52] U.S. Cl. ..... 38/93; 38/97; 38/77.5

[58] Field of Search ..... 38/16, 17, 74, 77.3, 38/77.5, 728, 88, 93, 97

[56] References Cited

U.S. PATENT DOCUMENTS

| | | | |
|---|---|---|---|
| 7,952 | 2/1851 | Clapp | 38/93 |
| 1,803,622 | 5/1931 | Kelsey | 38/97 X |
| 2,270,316 | 1/1942 | Kuhn et al. | 38/93 |
| 2,764,825 | 10/1956 | Coyne | 38/93 |
| 3,238,650 | 3/1968 | Mullen | 38/93 |
| 3,603,012 | 9/1971 | Haynes | 38/97 |
| 4,822,686 | 4/1989 | Louison | 38/93 X |
| 4,835,363 | 5/1989 | Hoffmann | 38/77.8 X |

FOREIGN PATENT DOCUMENTS

| | | |
|---|---|---|
| 0206121 | 12/1986 | European Pat. Off. . |
| 2508479 | 9/1976 | Fed. Rep. of Germany . |
| 2616168 | 10/1977 | Fed. Rep. of Germany . |
| 2581402 | 11/1986 | France . |
| 2091527 | 7/1982 | United Kingdom . |

*Primary Examiner*—Werner H. Schroeder
*Assistant Examiner*—Ismael Izaguirre
*Attorney, Agent, or Firm*—Young & Thompson

[57] ABSTRACT

The smoothing iron sole possesses a coating of enamel on its surface intended to be applied to the articles to be ironed. This surface comprises enamel strips (4) in relief which are substantially parallel and extend in the longitudinal direction of the sole. The strips have a cross section which diminishes gradually from the front toward the rear of the sole.

11 Claims, 1 Drawing Sheet

FIG_1
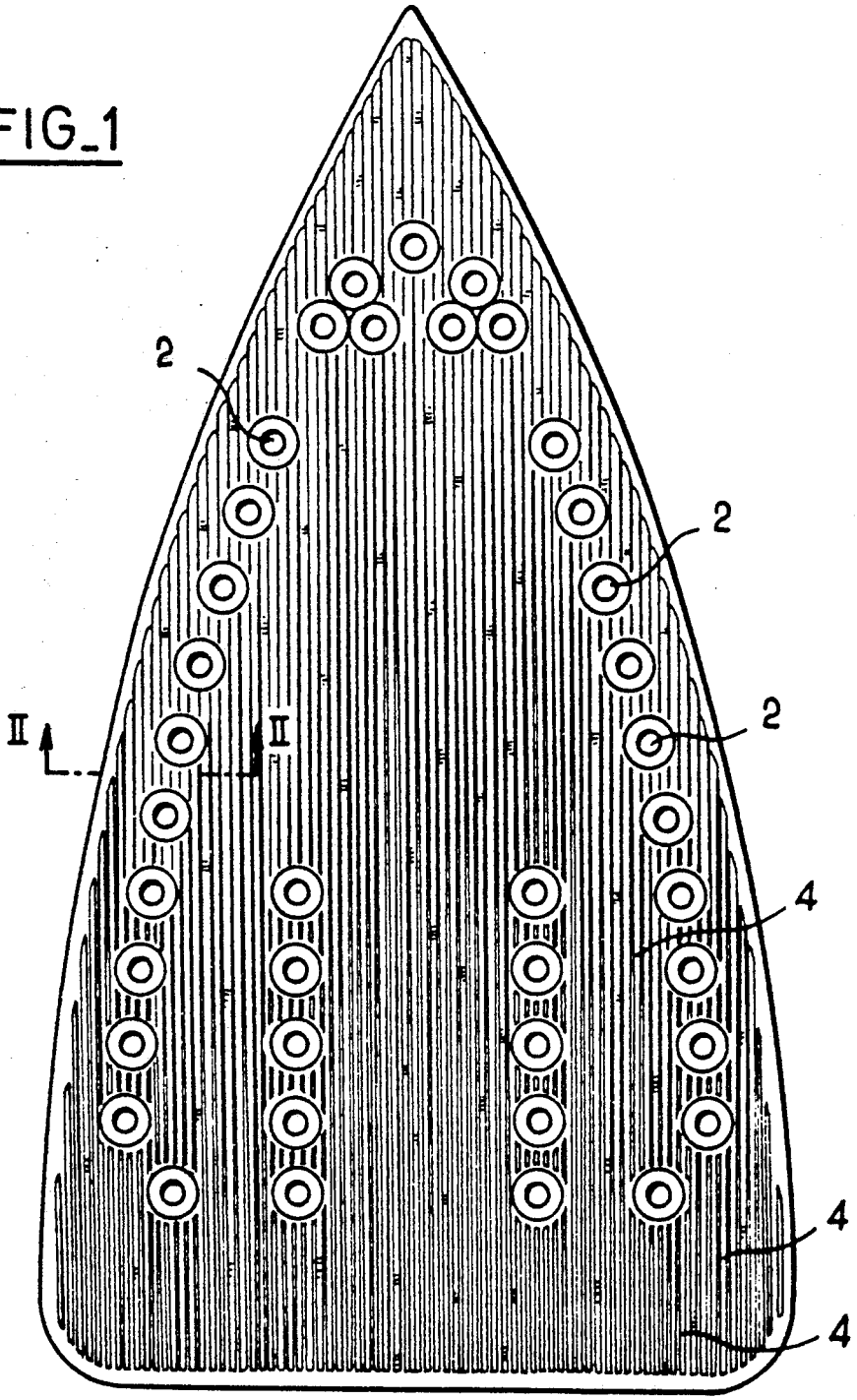
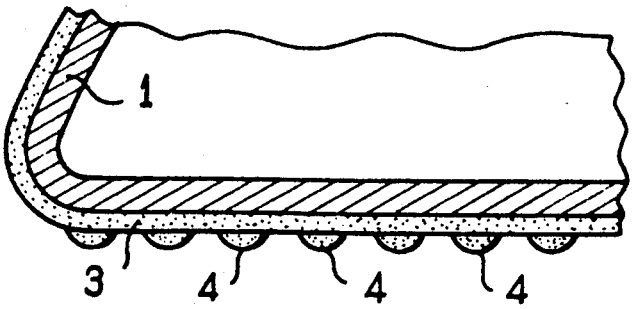
FIG_2

SMOOTHING IRON HAVING SCREEN PRINTED ENAMEL STRIPS WIDER AT THE FRONT AND NARROWER AT THE REAR OF THE PRESSING SOLE SURFACE

The present invention relates to a sole for a smoothing iron, particularly a steam iron, whose surface intended to be applied to the articles to be ironed is covered with enamel.

Currently, the soles of smoothing irons are made from metal (stainless steel or aluminum) whose surface is polished. It has in fact been considered that the best means of obtaining good quality ironing was to use a sole having the least rough surface possible, in a manner such as to obtain a good heat transfer between the sole and the articles to be ironed, while also reducing the coefficient of friction, which improves the "slip" of the iron on the articles.

Such polished soles are, however, sensitive to scratching and staining, particularly when they are made of aluminum.

The Applicant Company has eliminated this disadvantage by proposing soles made of iron and covered with a layer of enamel, as described in its French Patent 2,581,402.

It has moreover found that this layer of enamel achieves a surprising improvement in the "slip" of the sole of the iron, particularly when hot.

The Applicant Company has pursued its researches with a view to improving the quality of ironing, and in particular the slip of the sole of smoothing irons.

Numerous attempts have been made in this direction. In particular, U.S. Pat. No. 2,270,316 describes a smoothing iron sole whose surface possesses a multitude of microscopic grooves obtained by abrasion with an emery cloth or the like, and extending in the longitudinal direction of the sole. The surface thus engraved is covered with a thin layer of chromium, which adapts to the profile of the underlying grooves.

The above-mentioned patent indicates that the sole thus treated possesses a lower friction resistance relative to the surface to be ironed.

However, such a sole is very costly to produce and is very sensitive to stains which are difficult to clean, in a manner such that the improvement in slip which it theoretically makes possible to obtain very rapidly develops into a reverse result.

The object of the present invention is to remedy the above disadvantages by proposing an enameled sole having a clearly improved "slip", which is insensitive to stains and inexpensive to manufacture.

According to the invention the surface of the sole intended to be applied to the articles to be ironed comprises enamel strips, in relief, which are substantially parallel and extend in the longitudinal direction of the sole.

These enamel strips in relief make it possible to reduce the surface area of contact of the sole with the textiles to be ironed and hence to reduce the coefficient of friction, particularly in the longitudinal direction of the sole, that is to say in the direction in which the sole has to be moved in order to obtain a good quality of ironing.

These enamel strips, unlike the engraved microgrooves in the metal of the conventional sole, do not render the sole sensitive to staining.

Because these enamel strips require no particular preparation of the surface of the sole, they do not affect the manufacturing cost thereof.

Moreover, in the case of a steam sole, these enamel strips in relief promote the diffusion of the steam between the sole and the textiles.

According to a preferred embodiment of the invention, the edge of the strips is rounded. This rounding clearly promotes slip.

According to an advantageous embodiment of the invention, said enamel strips are applied on a layer of enamel.

This feature makes it possible to obtain excellent adhesion of the enamel strips, while rendering the entire surface of the sole insensitive to stains.

Preferably, said enamel strips are applied by screen printing. This technique makes it possible to obtain enamel strips having a very accurate and clear outline, that is to say without flashes liable to reduce the slip of the sole.

Preferably again, said enamel strips are produced by vitrification of a composition of enamel particles.

The effect of this vitrification is to round the edges of the strips and to glaze the surface thereof, which likewise promotes slip.

Other particular features and advantages of the invention will also become apparent in the description which follows.

In the attached drawings, given by way of non-limiting examples:

FIG. 1 is a plan view of the enameled sole according to the invention,

FIG. 2 is a sectional view on a larger scale in the plane II—II of FIG. 1.

The steam iron sole shown in the figures comprises a metal plate 1, for example of laminated aluminum, pierced by apertures 2 for the passage of the steam.

The surface of this sole that is intended to come into contact with the articles to be ironed is covered with a continuous layer of enamel 3. This layer of enamel 3 is self covered by enamel strips 4 in relief, mutually parallel and extending in the longitudinal direction of the sole. These relief strips 4 possess a rounded profile in section.

Preferably, the layer of enamel 3 is applied by spraying an aqueous composition of vitrifiable particles of enamel. The enamel strips 4 are applied by screen printing to the layer of enamel 3 from a composition of enamel particles which are vitrifiable substantially at the same temperature as those of said layer 3. This layer 3 and these strips 4 are stoved simultaneously, which permits excellent adhesion of these strips 4 to the layer of enamel 3 to be obtained.

The enamel strips 4 in relief may possess a thickness of between 10 and 100 μm.

The width of the strips 4 may be between a few hundredths of a mm and a few millimeters.

Moreover, these enamel strips 4 preferably have cross-section which diminishes gradually from the front towards the rear of the sole.

Hence, the coefficient of friction per unit surface between the surface of the sole and the articles to be ironed diminishes gradually from the front towards the rear of the sole, which is favorable for obtaining a good quality of ironing.

Furthermore, the Applicant Company has found during tests that it was advantageous for the ratio of the surface of the relief strips 4 to the surface of the sole not covered by the strips to be between 0.5 and 2.5.

The best results have been obtained when said ratio is between 1.8 and 2 at the front of the sole, between 0.75 and 0.85 at the center of the sole and between 0.6 and 0.7 at the rear of the sole. Moreover, it has been established that it was advantageous for the surface of the sole which possesses the relief strips 4 to possess a central cavity which covers between 25 and 70% of the surface of the sole, and whose depth varies gradually from 0 close to the edges of the sole to a value of between 0.3 and 1 mm close to the center of the sole. This cavity makes it possible further to reduce the slip of the iron sole on the articles to be ironed. It has likewise been found that it was advantageous for the hardness of the enamel forming the relief strips 4 to be higher than that of the enamel 3 on which said strips 4 are applied.

Hence, wear on the relief strips is reduced at the expense of wear on the layer of enamel to which the strips are applied. This more rapid wear on the layer of enamel increases the amplitude of the relief of the strips, and reduces the slip.

It is advantageous for the hardness of the enamel of the relief strips 4 to be at least 15% greater than that of the enamel of the underlying layer.

Thus, the hardness of the underlying layer of enamel, measured with a Vickers indenter applied under a force of 0.3 daN is preferably between 470 and 570, while that of the enamel of the relief strips is preferably between 540 and 650.

An example is given below of the application of the enamel coating of the sole according to the invention.

An aqueous suspension of enamel frit (for aluminum) is sprayed onto the surface of the aluminum plate 1 of the sole to form the first layer 3. After drying of this first layer 3, a second layer of enamel is applied through a printing screen reproducing the strips 4, in the form of an oily paste containing:

(a) 100 parts by weight of an enamel frit for aluminum made up, for example, of:

34% of $SiO_2$
20% of $Na_2O$
10% of $K_2O$
2% of $Li_2O$
20% of $TiO_2$
2% of $Al_2O_3$
2% of $P_2O_5$
10% of $V_2O_5$ (b) 5 to 10 parts of inorganic pigments which are resistant to a temperature at least equal to 600° C.

(c) 25 to 45 parts of wood turpentine.

This layer is dried.

The two layers of enamel thus obtained are stoved simultaneously at a temperature of the order of 550° C.

This stoving causes the particles of enamel to vitrify. This sintering has the effect of rounding the edges of the enamel strips 4 and smoothing the surface thereof, eliminating any acute angles and any roughness.

The enamel strips 4 formed on the surface of the sole substantially reduce the surface area of contact between the sole and the textiles to be ironed. Moreover, by virtue of the rounded and smooth profile of these strips 4, the "slip" of the sole is notably improved, particularly in its longitudinal direction which corresponds to the normal direction of ironing.

The enamel strips 4 likewise have the effect of distancing the surface of the sole, from which the apertures 2 for the passage of the steam emerge, by a few tens of microns relative to the surface of the textile articles, which creates steam diffusion channels distributed over the entire sole, which promote the action of this steam on the textiles.

Table 1 below demonstrates the surprising improvement in slip of a sole according to the invention as compared with other soles.

TABLE I

| | Reference no. of iron | | | | | | | | |
|---|---|---|---|---|---|---|---|---|---|
| | 1 | 2 | 3 | 4 | 5 | 6 | 7 | 8 | 9 |
| Sole covering | Aluminum | Enamel | Stainless steel | Chrome steel | Enamel | PTFE | Chrome steel | Chrome brass | Enamel + strips |
| Weight of empty iron | 1,375 g | 1,380 g | 1,400 g | 1,530 g | 1,130 g | 1,080 g | 1,510 g | 1,090 g | 1,380 g |
| Fabrics ironed | Measured tractive force | | | | | | | | |
| Polyester | 309 g | 352 g | 331 g | 431 g | 346 g | 217 g | 456 g | 353 g | 232 g |
| Wool | 244 g | 192 g | 270 g | 324 g | 171 g | 203 g | 302 g | 385 g | 115 g |
| Polyester/cotton 50/50 | 300 g | 189 g | 228 g | 349 g | 179 g | 204 g | 338 g | 303 g | 129 g |
| Cotton | 312 g | 157 g | 283 g | 336 g | 143 g | 295 g | 244 g | 401 g | 85 g |
| Cotton with steam | 347 g | 210 g | 298 g | 392 g | | 274 g | 245 g | 378 g | 176 g |

In this table, iron no. 2 comprises an enameled sole as described in the Applicant Company's French Patent No. 2,581,402.

Iron no. 9 is equipped with an enameled aluminum sole bearing enameled strips in accordance with the present invention.

The values for the measured tractive force illustrate the sole's capacity for slip.

These values show that the sole according to the invention slips distinctly better than the others whatever the nature of the textile ironed and the ironing temperature, and with or without steam.

This surprising improvement in slip is likewise demonstrated by Table 2 below, which shows the coefficients of friction obtained for different coatings of iron soles.

TABLE II

| | Reference no. of iron | | | | |
|---|---|---|---|---|---|
| | 1 | 2 | 3 | 4 | 5 |
| Sole covering | aluminum | enamel | stainless steel | chromium | enamel + strips |

TABLE II-continued

| | Reference no. of iron | | | | |
|---|---|---|---|---|---|
| | 1 | 2 | 3 | 4 | 5 (invention) |
| Fabrics ironed | Coefficient of friction | | | | |
| Polyester | 0.225 | 0.225 | 0.24 | 0.33 | 0.18 |
| Cotton | 0.225 | 0.11 | 0.205 | 0.185 | 0.06 |
| Wool | 0.175 | 0.14 | 0.195 | 0.22 | 0.09 |
| Cotton with steam | 0.25 | 0.155 | 0.22 | 0.195 | 0.135 |
| Polyester/cotton 50/50 | 0.22 | 0.14 | 0.16 | 0.24 | 0.10 |

Table II above shows, in particular, that the sole having relief strips according to the present invention provides in every case—whatever may be the nature of the textile material ironed—the lowest coefficients of friction.

We claim:

1. A smoothing iron sole having a front and a rear and having a surface to be applied to articles to be ironed, wherein said surface comprises enamel strips (4) in relief which are substantially parallel and extend in a longitudinal direction of the sole, the strips (4) having a cross-section which diminishes gradually from the front towards the rear of the sole.

2. The sole as claimed in claim 1, wherein an edge of the strips (4) is rounded.

3. The sole as claimed in claim 1, wherein said enamel strips (4) are applied on a layer of enamel (3).

4. The sole as claimed in claim 3, wherein the hardness of the enamel forming the relief strips (4) is higher than that of the enamel (3) on which said strips (4) are applied.

5. The sole as claimed in claim 1, wherein said enamel strips (4) are applied by screen printing.

6. The sole as claimed in claim 1, wherein said enamel strips (4) are produced by sintering a composition of enamel particles.

7. The sole as claimed in claim 3, wherein said layer of enamel (3) is applied by spraying a composition of vitrifiable particles of enamel, the enamel strips (4) being applied by screen printing to said layer (3) from a composition of enamel particles which are vitrifiable substantially at the same temperature as those of said layer (3), said layer (3) and said strips (4) being heated simultaneously.

8. The sole as claimed in claim 1, wherein said strips (4) possess a thickness of between 10 and 100 μm.

9. The sole as claimed in claim 1, wherein the strips (4) have a width which is between a few hundredths of a mm and a few millimeters.

10. The sole as claimed in claim 1, wherein the ratio of the surface of the strips (4) to the surface of the sole not covered by the strips is between 0.5 and 2.5.

11. The sole as claimed in claim 10, wherein said ratio is between 1.8 and 2 at the front of the sole, between 0.75 and 0.85 at the center of the sole, and between 0.6 and 0.7 at the rear of the sole.

* * * * *